United States Patent [19]

Lancaster et al.

[11] Patent Number: 4,553,374

[45] Date of Patent: Nov. 19, 1985

[54] ROTATABLE FILM WRAPPING APPARATUS FOR CYLINDRICAL LOADS

[76] Inventors: William G. Lancaster, 5101 Upper River Rd.; Patrick R. Lancaster, III, 14801 Burleigh Ct., both of Louisville, Ky. 40223

[21] Appl. No.: 454,974

[22] Filed: Jan. 3, 1983

[51] Int. Cl.[4] ..... B65B 13/12

[52] U.S. Cl. ..... 53/465; 53/556; 53/588; 53/210

[58] Field of Search ..... 100/13; 156/428, 430; 53/210, 399, 445, 465, 556, 588

[56] References Cited

U.S. PATENT DOCUMENTS

| | | | |
|---|---|---|---|
| 3,788,199 | 1/1974 | Sato et al. | 156/430 |
| 4,050,220 | 9/1977 | Lancaster et al. | 53/588 |
| 4,317,322 | 3/1982 | Lancaster et al. | 53/399 |

*Primary Examiner*—Lowell A. Larson
*Attorney, Agent, or Firm*—Gipple & Hale

[57] ABSTRACT

A stretch wrapping apparatus and process for wrapping and sealing random-sized loads, in which the load is surrounded with a plurality of tube forming support members which extend along the length of the load. A conveyor directly beneath the load supports the load and preferably incorporates at least one upper and one lower endless belt, rotating so that the upper surface of the upper belt and the lower surface of the lower belt are both carried in the same downstream direction at the same speed. The tube forming support members converge to the load with skids which do not support the load, and preferably have endless conveyor belts with an outer surface circulating in the same downstream direction and at the same speed as the lower dual conveyor. A stretched film web is wrapped around the tube forming support members, conveyor, and load by a film dispenser, wrapping the load as well as space in front of and behind the load. The film web wrapped around the load, tube forming support members, and conveyor resumes its memory position against the load when the ends of the tube forming support members and conveyor are encountered. A sealing mechanism collapses and seals the film web enclosures before and behind the load, to provide a sealed wrapped package.

29 Claims, 25 Drawing Figures

Fig. 3
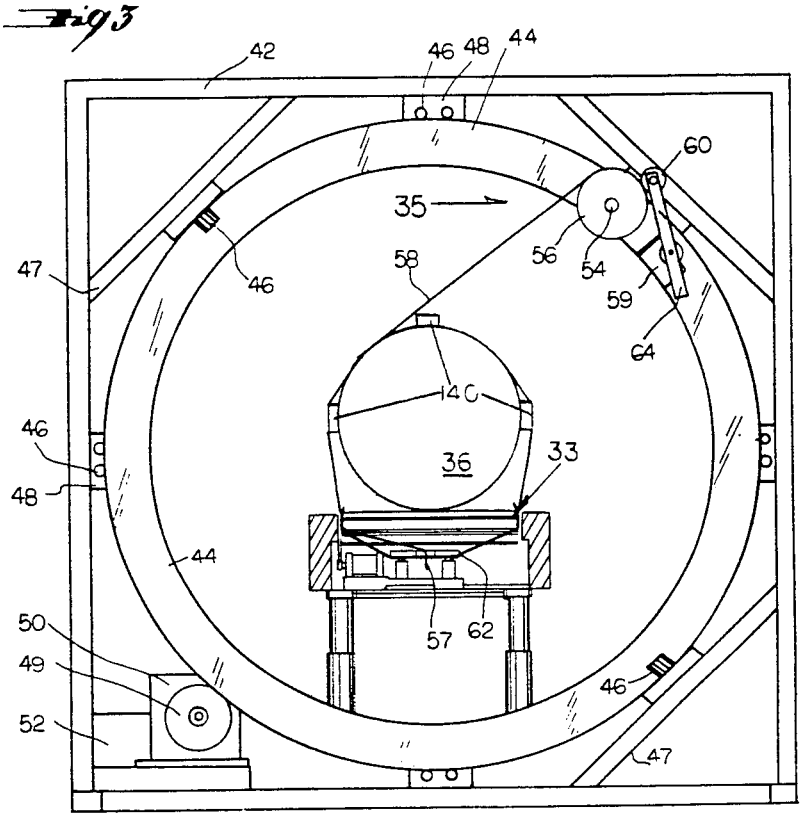
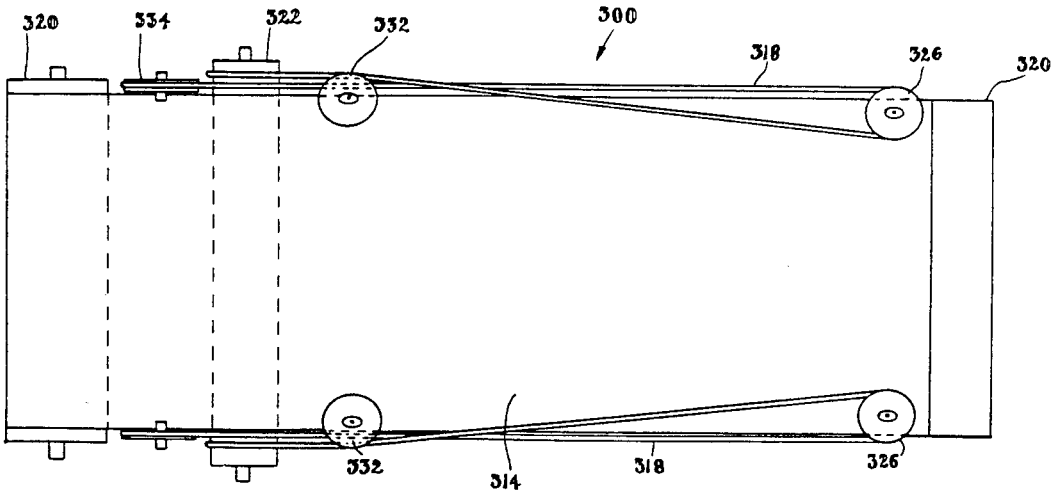
Fig. 4

ROTATABLE FILM WRAPPING APPARATUS FOR CYLINDRICAL LOADS

BACKGROUND OF THE INVENTION

The present invention generally relates to packaging and more particularly is directed to a rotating stretch wrapping apparatus and process for making unitary packages which completely enclose loads.

Case packing or boxing is a common way of shipping products. These products are generally stacked in a corrugated box or are wrapped with kraft paper with the ends of the kraft paper being glued or taped.

However, customer dissatisfaction with gluing is high because removal of glued cartons or bags from the unitized loads tends to tear outside layers of the cartons or product. Glue further demands interleaving for product orientation requiring more durable and expensive packaging material.

Some manufacturers use steel or plastic strapping to unitize the product. The problems incurred in the use of strapping are the requirement of costly corner protectors, danger of bending or snapping and injuring the operator while applying the high tension strapping material to the loads, settling due to moisture wetting the cartons, and the sides bulging or normal vibrations causing the straps to loosen and the load to come apart.

In another packaging alternative, tape is used to horizontally bind the top layer of stacked loads. However, tape is expensive and allows relatively free movement of all product surrounded.

Another way of packaging products is by putting a sleeve or covering of heat shrinkable material around the products and shrinking the sleeve to form a unitized package. The use of heat shrinkable film is described in U.S. Pat. Nos. 3,793,798; 3,626,645; 3,590,549 and 3,514,920. A discussion of this art is set forth in U.S. Pat. No. 3,867,806.

The fastest growing and one of the most economical ways of packaging products is by wrapping the product load with a web of stretched plastic film.

The elasticity of the stretched plastic film holds the products of the load under more tension than either shrink wrap or kraft wrap, particularly with products which settle when packaged. The effectiveness of stretched plastic film in holding a load together is a function of the containment or stretch force being placed on the load and the ultimate stretch of the total layered film wrap. These two functions are determined by the modulus or hardness of the film after stretch has occurred and the ultimate strength of the film after application. Containment force is currently achieved by maximizing elongation until just below a critical point where breaking of the film occurs.

The use of wrapping machinery to wrap stretched film around a load is well-known in the art. Four types of stretch wrapping apparatus are commonly used in the package industry and these types are generally described as spiral rotary machines, full web rotary machines, pass-through machines, and circular rotating machines.

A spiral machine is shown in U.S. Pat. No. 3,863,425 in which film is guided from a roll and wrapped around a cylindrical load in a spiral configuration. A carriage drives the film roll adjacent the surface of the load to deposit a spiral wrap around the load and returns in the opposite direction to deposit another spiral overwrap around the load.

In U.S. Pat. No. 3,788,199, tapes are spirally wound in such a manner that they overlap each other to provide suitable space therebetween when breatheability is required. In this disclosure, a heavy duty bag is prepared by spirally winding stretched tapes of synthetic resin in opposite directions, so that they intersect each other to form a plurality of superimposed cylindrical bodies which are bonded together to form a cylindrical network. The spirally wound inner and outer tapes of the superimposed cylindrical body intersect each other at a suitable angle, depending upon the application intended, the preferred embodiment having substantially equal longitudinal transfer strength. In this preferred embodiment, the tapes intersect each other at an angle of about 90°. The angle defined by the tapes constituting the cylindrical network may be determined by varying the interrelationship between the travelling speed of the endless belts carrying the tape and the rotating speed of the bobbin holders, which rotate a plurality of tape bobbins to deposit the tape onto the moveable belt.

Spiral wrapping machines which are currently commercially available are manufactured by Lantech, Inc. under Model Nos. SVS-80, SVSM-80, STVS-80, STVSM-80 and SAHS-80.

A full web type of apparatus which wraps stretched film around a rotating load is disclosed in U.S. Pat. No. 3,876,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Full web wrapping machines typical of those presently commercially available are Model Nos. S-65, T-65 and SAH-70 manufactured by Lantech, Inc.

Another type of machine for wrapping a pallet load commonly called a pass-through machine is disclosed in U.S. Pat. No. 3,596,434. In this patent, a pallet load is transported along a conveyor and the leading face of the pallet load contacts a vertical curtain of film formed by the sealed leading edges of film webs dispensed by two rolls of film on opposite sides of the path of the pallet load. The pallet load continues to move along the conveyor, carrying with it the sealed film curtain until the two side faces of the pallet load as well as the front face are covered by film web. A pair of clamping jaws then close behind the pallet load, bringing the two film web portions trailing from the side faces of the pallet load into contact with one another behind the pallet. The jaws then seal the film web portions together along two vertical lines, and cut the web portions between those two seals. Thus, the film web portions are connected to cover the trailing face of the pallet load, and the film curtain across the conveyor is re-established to receive the next pallet load. The pallet load may subsequently be exposed to heat in order to shrink the film web and apply unitizing tension to the load, as is disclosed in U.S. Pat. No. 3,662,512. Another disclosure of relevance to pass-through wrapping is U.S. Pat. No. 3,640,048 which shows that film may be applied to the top and bottom of the pallet load prior to the wrapping cycle when it is desired to cover all six surfaces of the pallet load with film. Commercial pass-through machines are currently manufactured by the Weldotron Corporation, Aktron Corporation, and SAT of France.

Various apparatus and processes have been developed to rotatably wrap stacked components to form a load.

Devices in which stationary loads are brought to a loading area and are wrapped by a rotating member which dispenses stretched film around a load are disclosed in U.S. Pat. Nos. 4,079,565 and 4,109,445. U.S. Pat. No. 4,079,565 discloses a full web vertical wrap of the load while U.S. Pat. No. 4,109,445 discloses the horizontal spiral wrap of a load. U.S. Pat. No. 4,050,220 issued to the inventors of the present invention discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated about the load and the supporting planar surfaces, wrapping the load and the supporting surfaces together. Plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the supported sides of the load. Further developments of this wrapping system by the inventors of the present invention are disclosed in U.S. Pat. Nos. 4,110,957 and 4,178,734.

U.S. Pat. No. 603,585 discloses a spiral wrapping device for enclosing individual newspapers in paper wrap for mailing purposes. Each newspaper is placed on a cylindrical core with a circumference approximately twice that of a newspaper, and each newspaper advances along the length of the core as the core is rotated. Wrapping paper is applied to the core at an angle and the wrapping paper between newspaper is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual items such as boxes in which each such item is conveyed along the surface of a horizontal sheet of wrapping material. The edges of wrapping material on each side of an item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied at an angle to form a cylindrical wrap.

In U.S. Pat. No. 2,863,270, two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting ends, applying wrapping material thereto. When sealed together, the pair of cylindrical items are removed from the cradle by hand.

A spiral wrapping machine for long bundles or items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap pattern. Because the normal load of filaments or similar items is much longer than the wrapping area, it is not necessary to provide support for the bundle in the wrapping area and, therefore, no support structure is wrapped with the bundle.

Commercial circular rotating wrapping machines are presently manufactured by Lantech, Inc., under the trademark LANRINER and are provided with wrapping ring inner diameters of 36 inches, 54 inches,72 inches and 84 inches. In differentiating between the various circular rotating wrapping machines manufactured by Lantech, Inc., the manual model has the designation SR; the full web models have the designations SVR and SAVR; the multiple banding models have the designation SVBR and SAVBR; the spiral models have the designation SVSR and SAVSR and the continuous wrap or bundler models have the model designations SVCR and SAVCR.

In these commercial machines, the load is pushed onto support tongues or wrapping rails and the load and support tongues are wrapped by a rotating supply of film. The film is stretched as it is rotated from the dispenser and the stretched film wrap holds the load together under compressive forces and also engages the tongues or wrapping rails on which the load is supported. The load is then pushed off or carried off of the tongues by the following load or take off conveyor respectively with the attendant frictional forces which result from the film engaging the tongues. Such forces can cause disorientation of the load.

It is apparent that the friction forces increase as the width of the tongues increase. Furthermore, the friction forces also increase as the tongues approach the corners of the load. Thus, prior art devices have had to utilize wrapping rails or tongues which did not extend past the corners or side edges of the load and have also had to contend with the problems of load support. While narrower tongues are preferred to reduce friction forces, strength requirements generally are such that because the bottom of the product or total weight of the load is supported by tongues, the tongues are necessarily thicker and wider and increase the friction forces. In addition, removal of the wrapped load from the tongues has caused difficulties since the present way to remove wrapped packages has been to push the packages from behind.

Other problems which occur include film tearing on the tongues when the load is being pushed off of the tongues along with product abrasion. Thus, bolts of cloth can become indented, metal pieces scored and product dented or crushed by passage over the tongues.

In an effort to overcome these problems the wrapping machine shown in U.S. Pat. No. 4,317,322 was developed. This system utilizes a plurality of conveyors, stacked vertically, to carry a load through a wrapping area encircled by a rotating ring wrapping apparatus. A film roll shaft extends from one side of the ring parallel to the rotational axis of the ring and to the conveyors. Film web is dispensed from a roll on the shaft, and is stretched by stretching means adjacent the shaft. The stretched tensioned web is wrapped about the load and the conveyors beneath the load. The bottom surface of the lower conveyor is driven at the same speed and in the same direction as the top surface of the upper load-carrying conveyor, so that the web wrapped around the load and conveyors is transported forward without drag. Beyond the wrapping area, a gap separates the conveyors from a subsequent takeoff conveyor, so that the tensioned web transported by the lower conveyor collapses against the underside of the load as the gap is encountered.

A swinging clamp arm is provided to clamp and cut film web at the end of each load. The clamp arm is driven in an arc to encounter the web between the roll and the load. Jaws mounted atop the clamp arm close on the web, and a cutting edge is then driven perpendicular to its length to sever the web between the jaws and the load. A brush atop the cutting edge brushes the web against underlying layers thereof to achieve a wrap seal based on web self-tackiness.

Spiral wrapping systems have previously failed to provide a satisfactory wrap to cover the leading and trailing ends of the load. Thus, where a load required end covering for protection or stability, it would have to be wrapped continually with film web being wrapped between loads to form a continuous casing. This method wastes film and, when the loads are separated by cutting the film wrap between the loads, provides only a loose covering which may snag and tear, causing a zippering of the entire wrap.

Another method utilized to provide end coverings is the manual draping of untensioned web around each end face prior to wrapping. This provides only a loose covering and requires careful attention to tucking of the draped portions during the wrapping process.

SUMMARY OF THE INVENTION

The present invention generally comprises a novel apparatus and process for making a wrapped unitary package surrounding a load. In the apparatus, a series of loads are fed lengthwise by conveyor through a rotating wrapping apparatus having a film web stretching mechanism and film dispensing mechanism, and each load is covered by a plurality of layers of stretched film to form a unitary package. As a load approaches the rotating wrapping apparatus, a plurality of tube forming members approach the periphery of the load, extending from the front of the load through the rotating wrapping apparatus. This allows the present invention to form front and rear sealable film web enclosures for loads of varying sizes. Each of the members, as well as the load-bearing conveyor beneath the load, preferably comprise a film-carrying conveyor facing outward from the load and transporting film web synchronously. The portions of each member facing the load experience no bearing force and, therefore, may be skid plates. The film web is wrapped by the rotating wrapping apparatus around the conveyor and members extending in front of the load to form a film web enclosure. The film web enclosure and the load are then transported forward and the rotating wrapping apparatus continues to wrap the load. The leading end of the load is carried past the ends of the conveyor and members a distance beyond the rotating wrapping apparatus, and the film web enclosure is then sealed against the leading end of the load by a sealing mechanism. The load then continues to move through the wrapping apparatus and wrapping continues until a second film web enclosure is created trailing behind the load. When the trailing end of the load passes the sealing mechanism, the trailing film web enclosure is likewise sealed, completing the enclosure of the load. Film clamps are extended to grip and hold the new leading end of the film web extending from the rotating wrapping apparatus, and the members are retracted to a maximum diameter position in preparation for the arrival of another load in the wrapping area.

The present invention overcomes the previously discussed problems in existing machines by utilizing a plurality of novel tube forming members which transport the stretched film web at the same speed as the load is carried through the dispensing area. The members surround the cylindrical load and support enclosures of stretched tensioned film web before and behind the load. The tube forming members automatically adjust to and accomodate consecutive loads of varying cross-sectional sizes. As the enclosures move forward and off the conveyor, a sealer mechanism forms a seal against the load face. Thus, a tight secure seal is formed without excess loose web attached to the load ends. Load integrity is improved substantially by the wrapping process, as is the reliability of the wrapping mechanism. While elongated and cylindrical loads are especially well suited to this apparatus and process, the invention may be applied to other loads as well.

These and other objects and advantages of the present invention will become more readily apparent by reference to the following detailed description thereof, when read in conjunction with the accompanying drawings.

BRIEF DESCRIPTION OF THE DRAWINGS

FIG. 3 is a rear elevational view of the apparatus of FIG. 2 showing the film dispenser of the present invention;

FIG. 4 is a top plan view of an alternate embodiment of the conveyor assembly of the invention with the belt end slider plate removed;

DETAILED DESCRIPTION OF THE DRAWINGS

Figure 1:
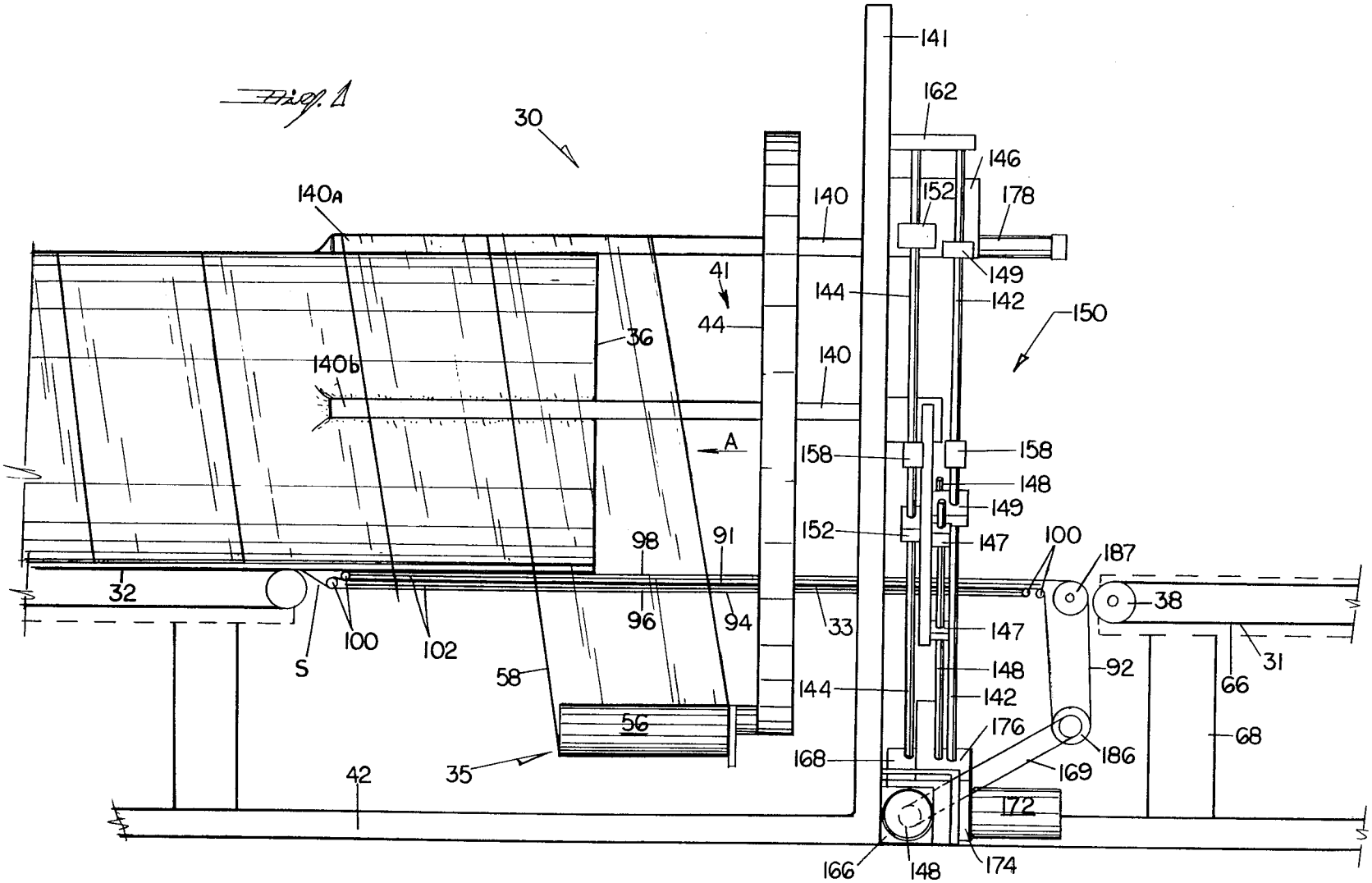
FIG. 1 discloses a side elevational view of the invention.

The best mode and preferred embodiment of the present invention is disclosed in FIGS. 1 through 3 and 7 through 15, and comprises a ring wrapping apparatus 30, comprising a feed conveyor 31, a wrap and load conveyor assembly 33, a film dispenser 35, a cutting mechanism 37, a take-off conveyor 32, and a positionable conveyor assembly 150.

As best seen in FIG. 1, a cylindrical load 36 is placed on a feed conveyor mechanism 31 by either manual or mechanical means. In the preferred embodiment, the feed conveyor 31 comprises an endless belt 66 circulating around rollers 38 which are rotatably journalled by suitable well-known conventional bearing means in brackets (not shown) which are mounted on frame supports 68. An alternate embodiment of the feed conveyor can take the form of a hydraulic or pneumatic pushing device (not shown) which can be used to engage an end of each cylindrical load 36 with a platen to push the load into the wrapping area. However, the conveyor embodiment is preferred and the belt 66 of the conveyor 31 of the present invention is preferably textured for a high coefficient of friction.

The infeed conveyor 31 carries the loads 36 to a wrapping area 41 of the positionable conveyor assembly. A steel "donut" or ring shaped film support member 44 is rotatably mounted downstream from frame 141 within a frame 42 to surround area 41. As shown in FIG. 3, the ring shaped film support member is supported on three planes by a plurality of guide rollers 46. If desired, the film support member can be constructed of aluminum. The guide rollers 46 project inward from the frame 42 on arms 47 and mounting plates 48 to engage the ring shaped member so that it can be driven in a predetermined path. A friction drive wheel 49 is positioned adjacent the ring member 44 at its base and engages the member 44 to rotate within the guide wheel rolling area. The friction drive wheel 49 is driven by a motor 50 having a shaft which is suitably connected with a drive reducer 52. A material roll dispensing shaft 54 is rotatably secured to the ring member 44 for rotation on its axis and is adapted to receive and hold a roll of film material 56.

Typical films which can be used in the stretch wrapping apparatus are EVA copolymer films with a high EVA content such as the films manufactured by Consolidated Thermoplastics "RS-50", Bemis "Super-Tough" and PPD "Stay-Tight" films. PVC films such as Borden Resinite "PS-26" can be used in the invention along with premium film such as Mobil-X, Presto Premium and St. Regis which utilize a low pressure polymerization process resin manufactured by Union Carbide of Dow Chemical Company. This resin, called linear low density polyethylene, has significantly different stretch characteristics than that of previous stretch films. These characteristics allow the film to withstand the high stress of extreme elongation without tearing during wrapping of the load.

It should be noted that film, film material and film web are used interchangeably throughout the specification.

In the preferred braking assembly used with the best mode of the invention and illustrated in FIG. 3, a film roll friction brake mechanism 59 is mounted to the ring shaped member 44. The brake mechanism 59 engages the surface of the film roll 56 with a roller member 60 rotatably mounted to support arm 64 to maintain constant tension on the film material. This constant tension allows the film web to cover the load with the desired degree of stretch provided on the film. The leading edge 57 of the web of stretchable material 58 is withdrawn from the roll 56 without tension and is placed in a rotating clamp assembly 62 adjacent the initial load before tension is applied. However, if desired, the leading edge can be placed under initial tension.

The brake mechanism 59 controls the force of arm 64 and its associated roller member 60 in engagement with the roll 56 to accomplish the braking process. The roller member 60 is constantly urged against the film roll 56 with a controlled force to provide a constant tension on the film roll and stretch the film 58 as it is being wrapped around the load 36.

Figure 10:
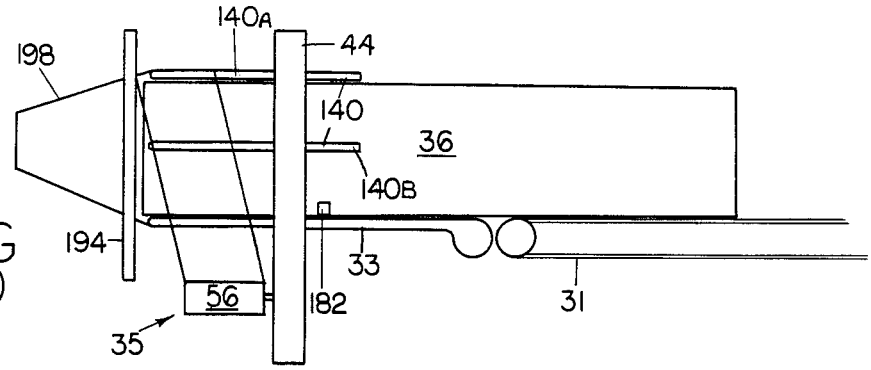
FIG. 10 is a schematic side view of the apparatus of FIG. 1 during a state of operation subsequent to that shown in FIG. 9.
Figure 18:
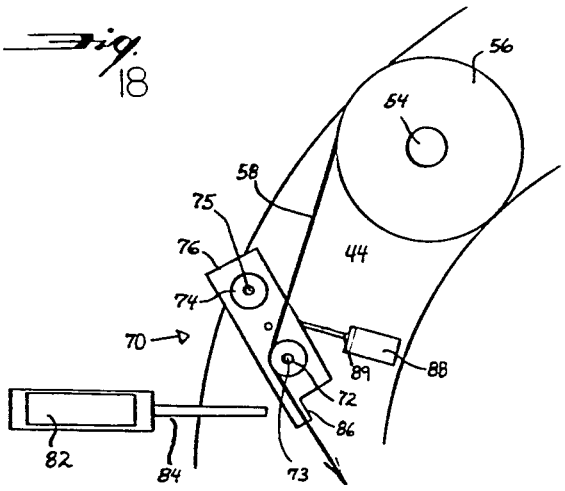
FIG. 18 is an enlarged elevational view of an alternate web stretching embodiment which may be utilized in conjunction with the apparatus of FIG. 3.
Figure 19:
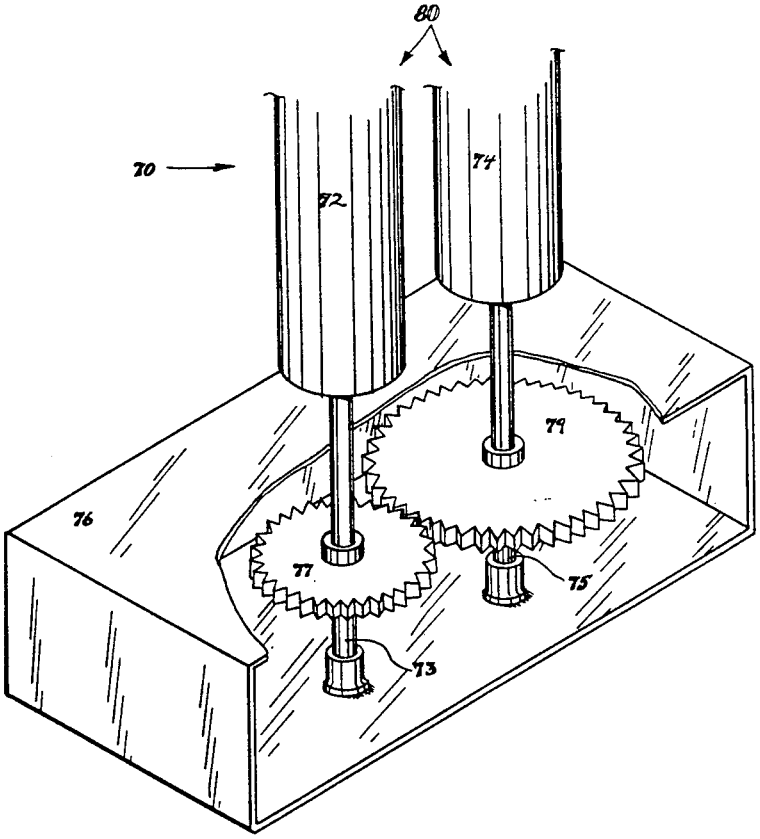
FIG. 19 is a perspective broken away view of the gear assembly utilized in the film web stretching apparatus of FIG. 18.

An alternate film stretching embodiment as shown in FIGS. 18 through 19 can be used to stretch the film web. In this embodiment the film web is passed through a prestretching assembly 70 and is tucked or fastened underneath the load as shown in FIG. 10 or held in clamp assembly 62. The prestretching mechanism 70 comprises connected roller members 72 and 74 which are rotatably mounted on respective shafts 73 and 75 which are in turn journalled into a housing 76. The housing 76 is rotatably mounted by means of a pivot assembly (not shown) to the ring member 44. The rollers 72 and 74 are connected together by gears 77 and 79 as shown in FIG. 19, which mesh together and are driven as the film web engages the rubber roller surfaces driving the rollers. The gears 77 and 79 operate so that the film web will drive the downstream roller 72 at a faster rate than the upstream roller 74 causing the film to be stretched in a narrow space 80 between the two rollers. The ratio of the gear 77 to the gear 79 ranges from 4:5 to 1:3. The prestretching mechanism 70 is pivotable so that the film may be threaded through the mechanism without engaging the upstream roller, and wrapped around the load 36 in a substantially unelongated condition until such time that the first corner of the load is covered with unstretched film. Before the start of the film wrap, a pneumatic cylinder 82 mounted to frame 42 is activated causing piston rod 84 to extend outward and engage the cam portion 86 of housing 76, pushing the cam portion inward to the center of the ring so that roller member 74 does not engage the film web. Since the connected roller members do not both engage the film web, the film web can be easily threaded through the stretching mechanism and tucked or held under the load 36. After the leading edge 57 of the film has been placed under the load, the wrap cycle is activated and the piston rod 84 is retracted into the pneumatic cylinder away from the housing 76. A coil spring (not shown) engages the housing and is connected to a shaft which is rotatably mounted to constantly urge the housing 76 away from the center of the ring member 44 so that both roller members 72 and 74 engage the film web. A fluid damper 88 of a type well-known in the art is secured to the ring member and engages the side of the housing 76 to prevent the roller member 74 from engaging the film web when stretching is not desired. The piston 89 of the damper is provided with a suitable orifice allowing the force of the coil spring to gradually push the piston rod and its associated piston inward at a predetermined speed allowing an appropriate amount of unelongated film web to be rotated around the load.

The wrapping conveyor assembly 33, as best seen in FIG. 1, comprises two stacked conveyors 92 and 94. These conveyors are standard plate-type conveyors well-known in the art comprising driven endless belts 96 and 98 mounted on a plurality of rollers 100. The rollers are supported by plates 102 secured in turn to a frame member (not shown) which holds the rollers in a rotatable position. The endless belt 98 is rotated in a direction A shown by the arrow in FIG. 1 and travels at the same speed as endless belt 96. Belt 98 is driven by motor assembly 166 shown in FIGS. 1 and 2, which is connected by sprocket 148, chain or belt 169, and roller 186 to drive conveyor 92. The upper segment of conveyor 92 travels downstream with the lower segment travelling upstream. The upper segment of conveyor 94 contacts the lower segment of conveyor 92 and is driven by friction therewith to travel upstream while the lower segment travels downstream. The upper and/or lower conveyor can comprise multiple belts.

While the wrapping conveyor assembly 33 comprising conveyors 92 and 94 is especially well-suited for use with the present invention, it is contemplated that conveyors of other types may also be utilized. For instance, a single plate which transports the load and film web in a downstream direction and is thereafter retracted upstream to receive a new load may also be used. One or more stationary plates may be used if the load is lengthly enough to extend through the wrapping area from the infeed conveyor to the take-off conveyor, so as to be transported by one or the other across the stationary plates during the entire wrapping process.

The construction of the invention allows a web of film to be wrapped around a load 36 carried from the infeed conveyor 31, and the positionable conveyor suitably 150. Thus, the stretched wrap of web 58 is wrapped around the conveyor assembly 140 and 33 and the load with both the load and wrap being carried by the conveyor assemblies in the same direction. The conveyor assemblies are activated carrying the load and wrap downstream to a take-off conveyor 32. When the load encounters the take-off conveyor 32 as shown in FIG. 1, the elongated stretched web coming off of the end of the conveyor assembly assumes its memory position against the load in the space "S" between the conveyor assembly 33 and take-off conveyor 32, allowing the contained load covered by stretched wrap to be carried away.

Figure 16:
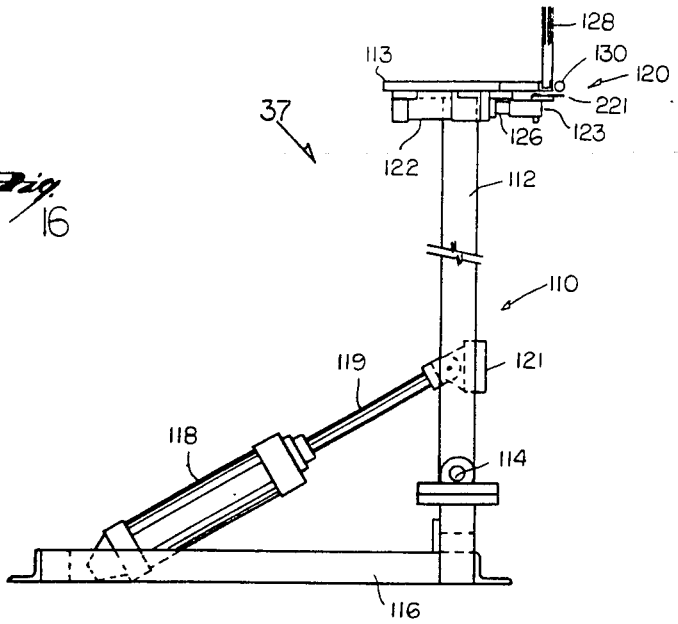
FIG. 16 is a front elevational view of a web severing mechanism used in the invention.
Figure 17:
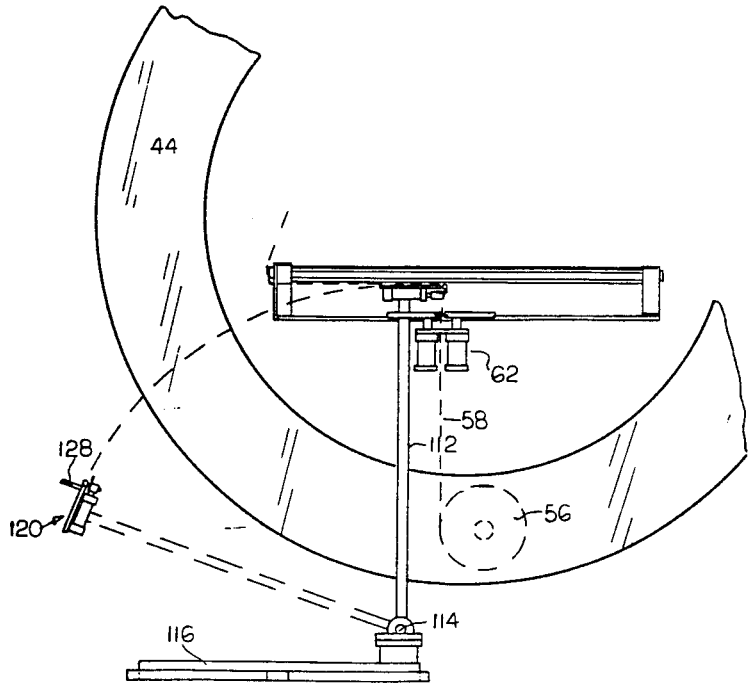
FIG. 17 is a front elevational view of the web severing device of FIG. 16 during cutting of the film web showing an initial phantom position.

A cutting mechanism 37 or 110 is used in the preferred embodiment and best mode of the invention and is illustrated in FIGS. 16 and 17, and incorporates a driven pivoted standard which is adapted to be projected upward to engage the film web between clamping apparatus 62 and the load 36. The cutting mechanism 110 comprises a support standard 112 which is pivotally mounted at 114 to a base member 116. The base member 116 can either be a part of frame 42 or be secured to frame 42. A pneumatic lifting cylinder 118 has one end mounted by a suitable ear or bracket attachment to the base member 116 with the end of its piston rod 119 attached to the support standard 112 by suitable means such as a yoke member 121. Upon activation of the pneumatic cylinder, the upright standard 112 is transported in an arcuate path into the film web 58. Mounted to the support standard is a cutting assembly 120 comprising a support plate 113, a pneumatic cylinder 122 mounted to the support plate 113 and a cutting blade assembly 123 mounted to the piston rod 126 of cylinder 122. A brush 128 is vertically mounted on the support plate to brush down the trailing edge of the film web against the conveyor assembly. A bumper member 130 is positioned in front of brush 128 to protect the brush base from initial contact with the film web and conveyor assembly. Upon appropriate activation as for example a predetermined number of revolutions of the ring member, which is sensed by an appropriate sensor device which will be discussed later in the specification, the cutting mechanism 110 is propelled upward so that the cutting assembly 120 engages the film web. The blade assembly 123 subsequently severs the film web. If desired, the cylinder 118 can be activated after cutting to propel the standard 112 forward a predetermined distance causing the brush 128 to engage the remainder of the trailing edge of the film web and wipe it against an underlying film layer.

The conveyor assembly 33 leads from the infeed conveyor 31 to a take-off conveyor 32 which is constructed like the infeed conveyor and runs at the same speed as the infeed conveyor. In order to control both conveyors at the same rate of speed, a suitable mechanical means (not shown) is set up to make the drive of both the infeed conveyor and the take-off conveyor equal to reduction gearing assembly 167 of the drive motor 166. Thus, if the motor stops, slows down or speeds up to drive the wrapping mechanism at different speeds, the infeed and take-off conveyors are simultaneously stopped, speeded up or slowed down so that the load is moved to conveyor assembly 33 and taken away from the conveyor assembly 33 at consistent relative speed.

Figure 5:
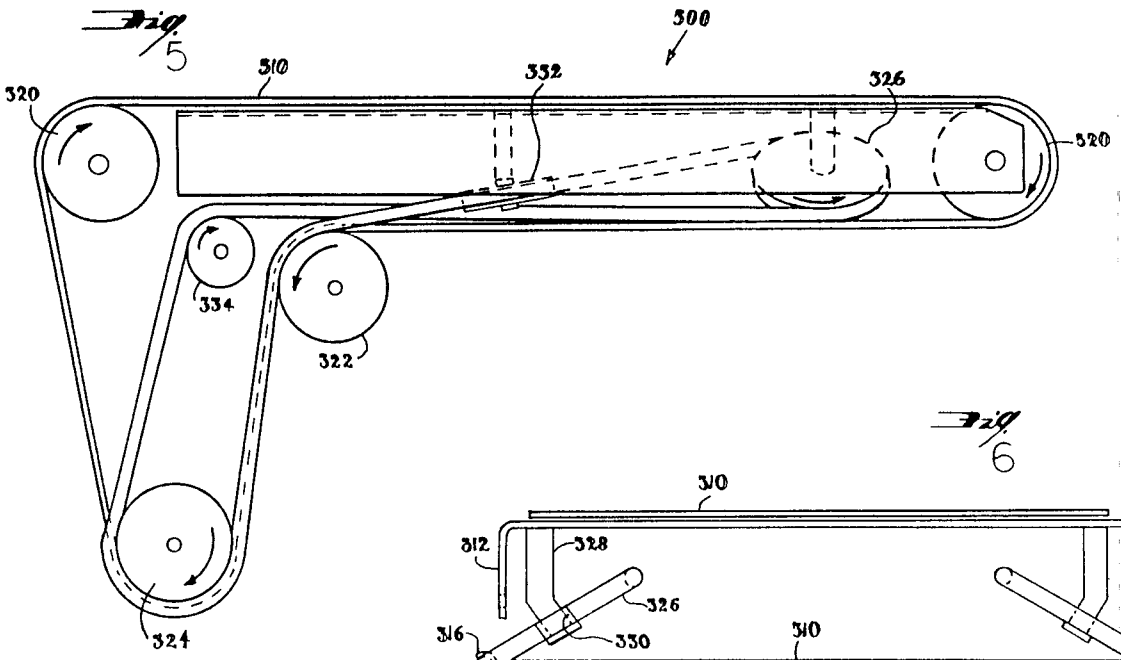
FIG. 5 is a side elevational view of the conveyor assembly shown in FIG. 4.
Figure 6:
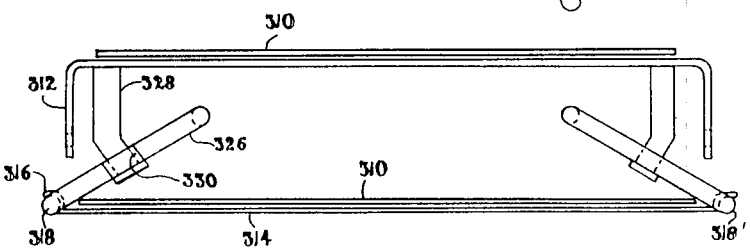
FIG. 6 is a front cross-sectional view of FIG. 5.
Figure 7:
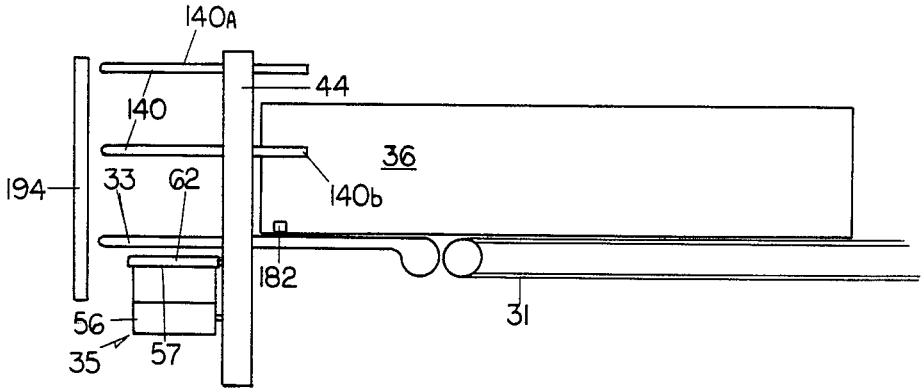
FIG. 7 is a schematic side view of the apparatus of FIG. 1 during an initial stage of operation.

An alternative conveyor assembly embodiment 300 can be used in place of the conveyor assembly previously disclosed. In this embodiment, the load carrying belt 310 as shown in FIGS. 4 through 6 is positioned over a steel slider bed 312 which can be suitably mounted to a frame or upstanding supports. Also secured to the frame or supports are a steel base plate 314 with guide rails 316 formed on each side to form channels to contain the round belt 318. The belt 318 is of a standard commercial type well-known in the art. The load carrying belt 310 is mounted on rollers 320, 322 and is driven by roller 324 as is well-known in the art. Belt 310 which is of the same composition as the conveyor belt which has previously been described has a friction surface which enables it to carry a load suitably along its surface. The round belts 318 and 318' are respectively mounted on either side of conveyor assembly 310 on downstream pulleys 326 which are mounted to shafts 328 by means of roller bearing assemblies 330. The belt is positioned by alignment pulleys 332 and 334 which are also rotatably mounted to shafts which are in turn secured to the frame of in case of pullies 326 and 332 of the steel slider bed 312. The round belts 318 and 318' are mounted on the outside of belt 310 around roller 322 and driver roller 324. Thus, it can be seen that rather than using the lower conveyor structure, which has previously been described, a round belt conveyor can be utilized which engages only the outer edges of the film web wrapped around the conveyor assembly. In this embodiment there is a short distance of approximately two to three inches between the end of the downstream pulley 326 to the edge of roller 320 so that the web of film will enage to a slight extent the tip of the conveyor assembly. However, since the web is being carried forward friction forces do not build up unlike those of prior art devices. The operation of the wrapping apparatus is the same as that of the preferred embodiment.

Figure 2:
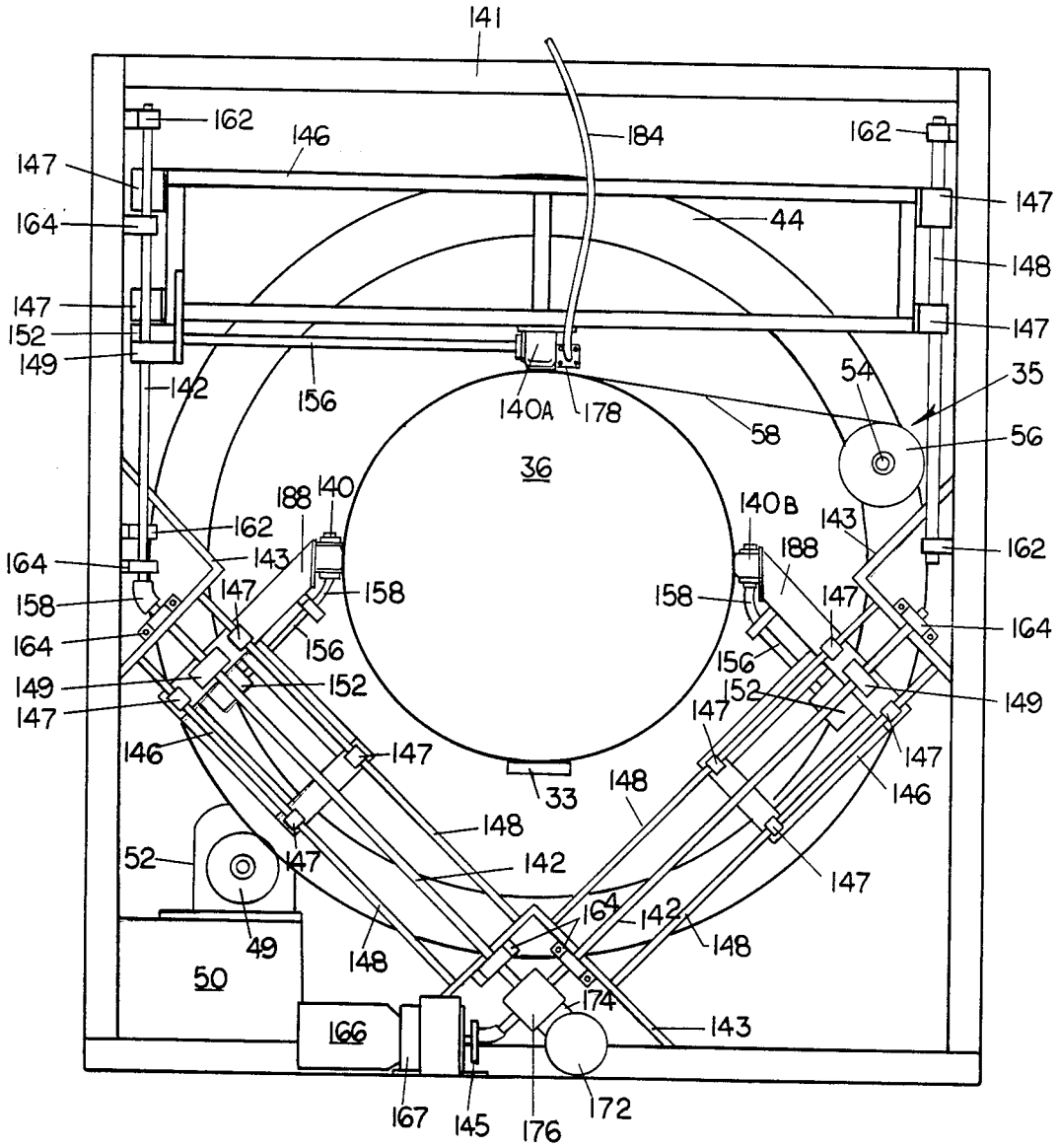
FIG. 2 is a front elevational view of the positionable conveyor apparatus of FIG. 1.

As is best seen in FIGS. 1 and 2, a positionable conveyor assembly 150 comprising a frame 141 and a plurality of tube forming support members 140, surround the load 36. Each of the support members 140 is mounted on a displaceable frame 146 which in turn is slideably mounted on a plurality of frame-bearing shafts 148. Conveyor drive motor 166 is coupled through reducer 167, sprocket 145, and right-angle gearbox 168 to shafts 144. Each shaft 144 passes through a drive transfer gear 152 mounted to a frame 146, and each gear 152 transfers rotary motion from shaft 144 to a conveyor axle 156 coupled to a member 140 mounted to frame 146. Thus, the motor 166 drives the wrapping conveyor assembly 33 and the members 140 at a common speed.

A displacement motor 172 is provided for moving displacement frame 146 along shafts 148 on displacement bearings 147. Each displacement drive shaft 142 passes adjacent a corresponding frame 146 and is preferably a ball screw shaft coupled to each frame 146 through a ball screw 149. Thus, as each shaft 142 rotates, each frame 146 will move backward or forward along shafts 148, depending on the direction of rotation of shafts 142.

Displacement motor 172 drives another right-angle gear box 176 through displacement reducer 174. Right-angle gear box 176 drives displacement drive shafts 142, which extend parallel to shafts 148. Drive shafts 142 may be passed through journal bearings 164 mounted to frame extensions 143 and through angular transfers 158, which may be universal joints or flexible drive shaft portions, in order to deliver motive power to adjacent frames 146 travelling in differing directions. In this regard, it should be noted that although three such frames 146 and members 140 attached thereto are illustrated, one or more such frames and members 140 may be utilized by varying the width of the members 140.

As illustrated, a top member **140*a* is carried along a vertical line passing through wrapping conveyor 33, and two side members 140*b* will be carried along 45° diagonal lines also passing through conveyor 33. Thus, for any size cylindrical load resting atop conveyor 33, the converging members 140 will approach and, optionally, contact the load at points dividing the periphery of the load into 90° segments with respect to the wrapping conveyor 33**.

The preferred form of the tube forming support members 140 are illustrated in detail in FIGS. 22–25. Each comprises a positionable conveyor incorporating a U-shaped conveyor track 240 and a conveyor support plate 242 attached thereto. Track 240 and support plate 242 are elongated and define therebetween a channel through which an endless conveyor belt 248 may pass. Conveyor belt 248 moves along the exterior surface of the support plate 242 in the direction of travel of the load 36, around a free-wheel roller 250 at the end of each conveyor 240, and in a direction opposite the travel of load 36 when it moves through the channel defined between support plate 242 and track 240.

Because each member 140 is conveying only the film web 58 wrapped around the load and not the weight of the load itself, the surface of each member 140 in contact with the load 36 need not move with the load, and can be a low-friction skid plate 244 coupled to track 240.

At the end of each member 140 opposite the frame 141, the support plate 242 ends adjacent free-wheel roller 250. Free-wheel roller 250 is mounted on axle 252 which extends beyond each end of roller 250 through bores or races in opposite sides of track 240. Axle 252 may be held to track 240 by, for instance, an axle pin 254 placed in a through going bore defined by track 240 and one end of axle 252.

Figure 20:
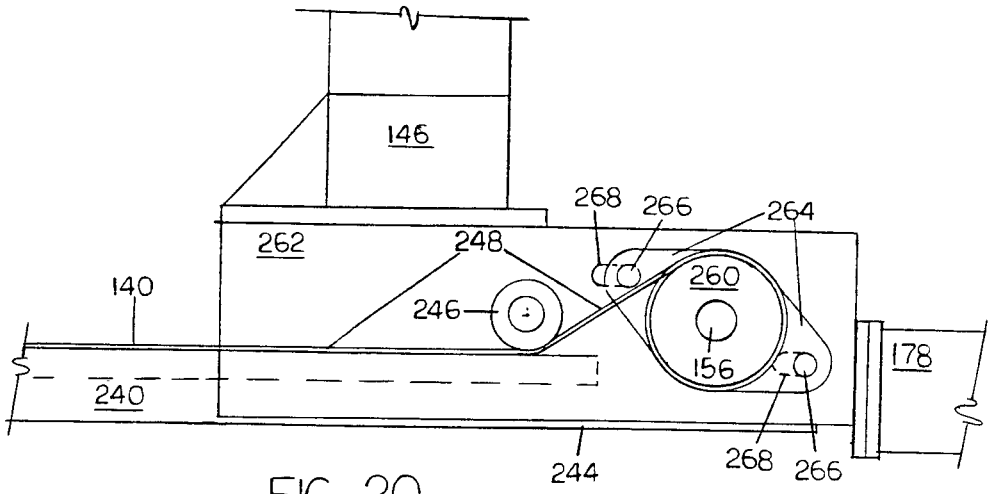
FIG. 20 is an enlarged isolated side elevational view of a portion of the positionable conveyor apparatus of the invention.
Figure 21:
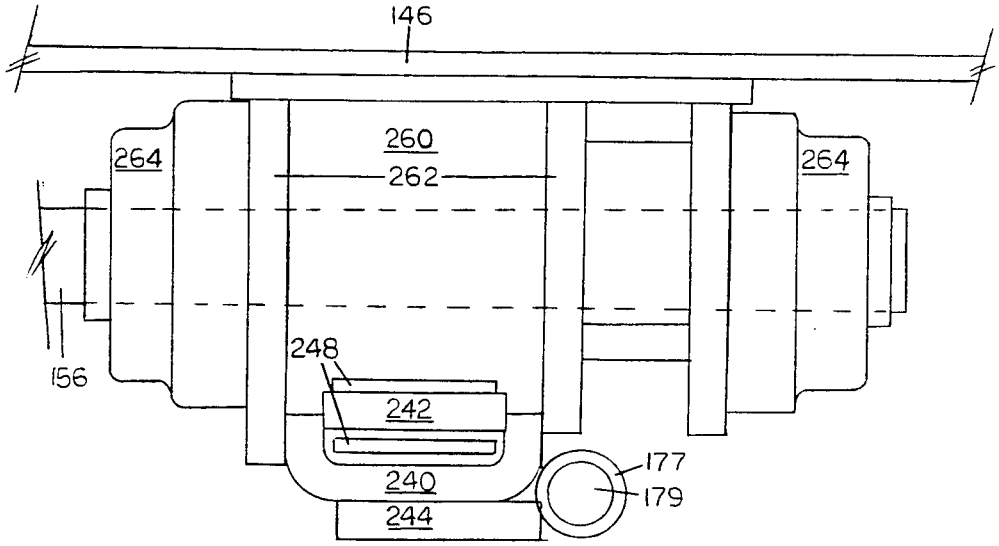
FIG. 21 is a front view of the apparatus of FIG. 20.
Figure 22:
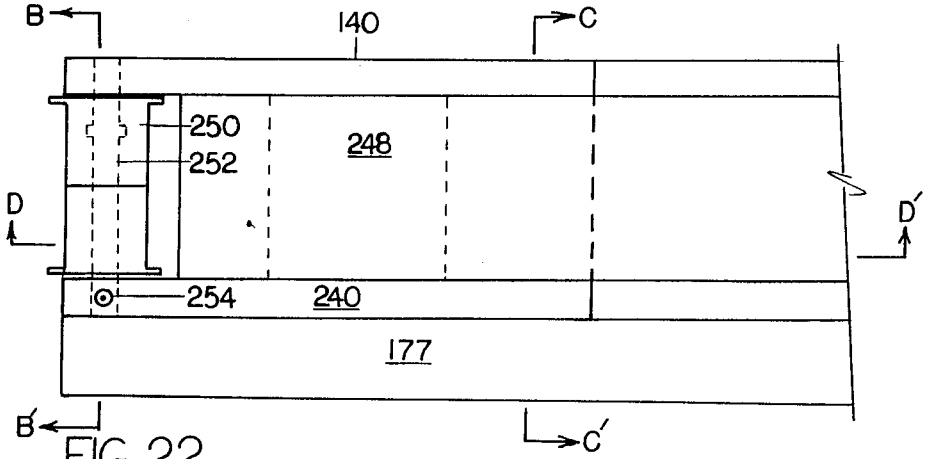
FIG. 22 is a top view of an opposite end of the apparatus of FIG. 20.
Figure 23:
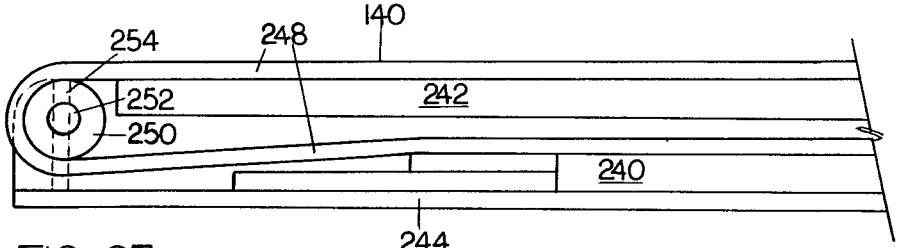
FIG. 23 is a cross-sectional view taken along line D—D' of FIG. 22.
Figure 25:
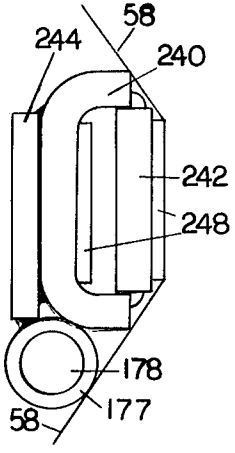
FIG. 25 is a cross-sectional view taken along line C—C' of FIG. 22.
Figure 24:
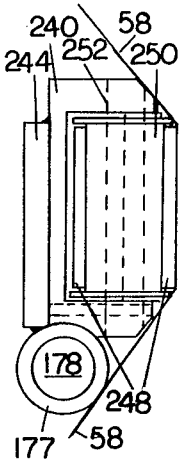
FIG. 24 is a cross-sectional view taken along line B—B' of FIG. 22.

As shown in FIGS. 20 and 21, track 240 is mounted to housing 262, which is in turn mounted to displacement frame 146. The drive roller 260 is mounted to and driven by axle 156, which is journalled to hubs 264. The hubs 264 are in turn mounted to housing 262. An oversized drive roller 260 is utilized in order to maximize friction contact area with endless belt 248 and to apply drive force to the endless belt 248. A free-wheel pinch roller 246 is also journalled to housing 262 to depress the upper belt segment of belt 248 against the support plate 242 as the belt 248 comes off the roller 260. A hub 264 is mounted on tension adjustment slots 268 defined in each side of housing 262. The hub 264 is held to the housing 262 by tension adjustment bolts 266 placed through slots 268. The bolts 266 may be loosened to reposition axle 156 and drive roller 260 backwards or forwards along housing 262 in order to vary the length of and tension on belt 248.

A film support actuator preferably comprising a cylinder 178 may also be mounted to housing 262 with a film support rod 179 extending through rod column 177 extending along the length of one side of track 240. A load contact sensor switch of any well-known conventional type (not shown) may also be mounted to track 240 at an end adjacent housing 262.

The take-off conveyor 32 is spaced apart from the downstream end of wrapping conveyor 33, in order to allow film web 58 wrapped around conveyor 33 and members 140 to resume its memory position under tension against load 36 as the load moves downstream away from conveyor 33 and positionable conveyors 140. As will be described in greater detail below, at least one complete revolution of film web 58 is wrapped about wrapping conveyor 33 and members 140 to form a first film web enclosure adjacent a leading end of the load, and a second film web enclosure adjacent a trailing end of the load. Any well-known conventional load edge detector 182, as shown schematically, may be placed within the positionable conveyor assembly 150 and operatively coupled so that wrapping conveyor 33 is halted in order to initiate wrapping of the conveyors in front of the leading end of the load. Edge detector 182 may also be utilized to detect a trailing end of the load, and to halt operation of the film dispenser at a predetermined time after the trailing end of the load has passed, in order to form a second film web enclosure circling the conveyors adjacent the trailing end of the load. A second load edge detector 183, which may also be of any well-known conventional type, is placed adjacent the downstream roller of wrapping conveyor 33 to detect the passage of a leading or trailing load edge. The second detector 183 is also operatively coupled to halt operation of conveyor 33 and members 140 to permit sealing of the first film web enclosure against the leading load end by sealing mechanism 194. Likewise, edge detector 183 will halt operation of take-off conveyor 32 at a predetermined time after passage of the trailing end of the load has been detected, allowing sealing mechanism 194 to seal the second film web enclosure against the trailing end of the load.

Although the illustrated form of tube forming members 140 is preferred, other forms may serve also to support the leading and trailing enclosures of film web. For instance, each member may comprise a bar which approaches a load to establish the size of the load, is wrapped with film web to form a leading enclosure, and is then transported forward along its axis together with the load to carry the leading enclosure to the sealing mechanism.

The sealing mechanism 194 is illustrated schematically and may be of any conventional well-known type for sealing film web against a load face. As one example, the sealing mechanism may comprise a pair of parallel sealer bars (not illustrated) which converge on one another across the direction of load travel through the leading or trailing film web enclosure to seal the web against the load face by application of heat. In such an arrangement, when film support rod 179 is extended beyond the leading edge of the load to support the leading film web enclosure, then the rod 179 is withdrawn just prior to contact of the sealer bars with the rod 179, in order to avoid jamming of the bars against the rod and subsequent failure to make a seal. Alternatively, since the rod extends outside the surface of the load, the sealer bars may simply be shorter than the height of the rod in order to avoid contact therewith, or may be notched to provide a hole within which rod 179 fits without jamming the bars.

The steps of operation of the present invention are disclosed in FIGS. 7 through 15. Beginning with FIG. 7, the leading edge 57 of film web 58 extending from roll 56 below conveyor 33 is gripped by clamps 62, and members 140 and frames 146 are retracted to a predetermined maximum distance by operation of displacement motor 172 through displacement reducer 174 and displacement gear box 176 to rotate displacement drive shafts 142. Rotation of shafts 142 causes displacement screws 149 to carry frames 146 along the frame-bearing shafts 148. When the frames 146 have been fully retracted, a load 36 is advanced on feed conveyor 31 until a front edge of the load 36 is detected by load edge detector 182. A leading end portion of the load 36 is surrounded by members 140 when operation of the conveyor 31 is halted.

Figure 8:
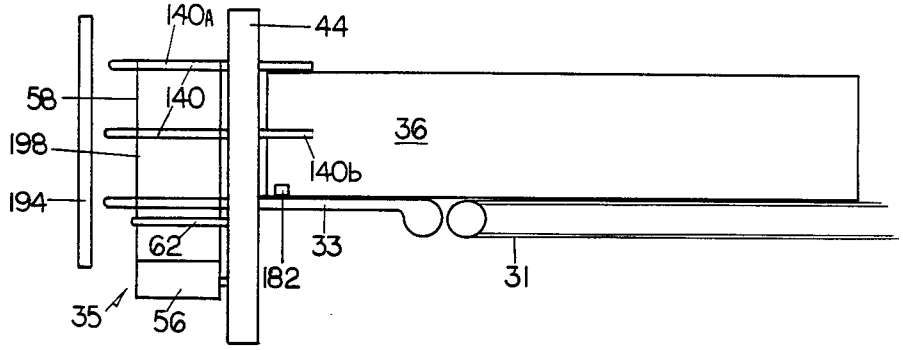
FIG. 8 is a schematic side view of the apparatus of FIG. 1 during a stage of operation subsequent to that illustrated in FIG. 7.

As shown in FIG. 8, the direction of travel of frames 146 is then reversed, to converge the members 140 on the load 36. This reversal of direction may be accomplished by reversing the direction of operation of motor 172 or, alternatively, by shifting gears within displacement gear box 176.

The tube forming support members 140 will preferably contact the surface of load 36 simultaneously when converging at a uniform speed on a cylindrical load with its axis directly above and parallel to conveyor 33. Thus, a contact switch placed immediately adjacent top member **140*a* will suffice to halt all conveyors 140 against a cylindrical load 36. If any cylindrical load 36 is placed off center on conveyor 33, a converging side member 140*b* will roll the load 36 across conveyor 33 until a center point is reached at which all members 140 contact the load 36**.

Following contact and centering of the load by the members 140, moving ring 44 is rotated by activating drive motor 50. The leading edge 47 of film web 58 is held within clamps 62 as film roll 56 is carried on film shaft 54 by ring 44 about members 140 ahead of the front end of the load. Film brake 59 or a suitable prestretch apparatus may be activated to cause film 58 to be dispensed by rotation of film roll 56 in a stretched condition, and more than one revolution of ring 44 is completed. The clamps 62 are then rotated and withdrawn to release the film leading edge 57, and the film 58 in stretched condition assumes a memory position against the bottom of conveyor 33. Thus, the film web enclosure 198 is formed in front of load 36. The enclosure 198 should extend in front of load 36 to a distance of at least the load radius plus four inches.

Figure 9:
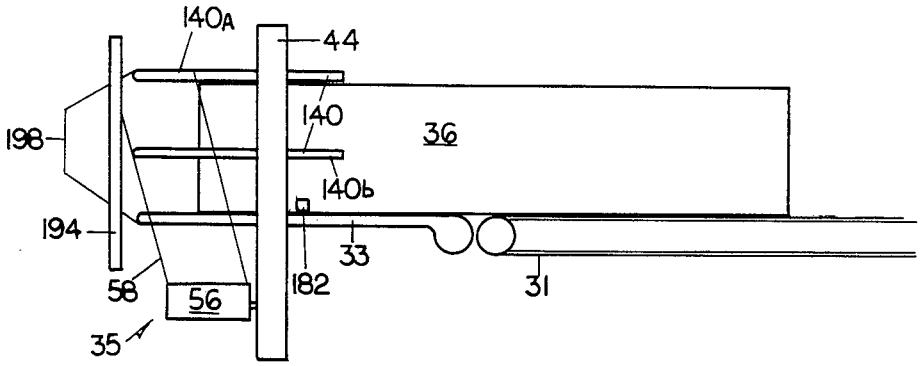
FIG. 9 is a schematic side view of the apparatus of FIG. 1 during a stage of operation subsequent to that illustrated in FIG. 8.

As shown in FIG. 9, conveyor drive motor 166 is activated to drive reducer 167, gear box 168 and chain 169. Chain 169 in turn drives drum 186 about which the upper conveyor 92 of wrapping conveyor 33 passes. The lower return surface of upper conveyor 92 is in contact with the upper surface of lower conveyor 94, thereby driving lower conveyor 94 synchronously by friction. As the upper surface of upper conveyor 92 carries the load forward, the lower surface of lower conveyor 94 carries the wrapped film web 58 forward at the same speed. Simultaneously, conveyor drive shafts 144 are rotated to drive conveyor transfer gears 152 mounted on frames 146. The conveyor transfer gears 152 in turn drive conveyor axles 156 which may pass through angular transfer means 158 to rotate bearing 190 and, thereby, conveyor belts 192. Thus, each conveyor belt 248 on members 140 will carry the film web enclosure 198 forward at the same speed as the load 36.

When motor 166 begins operation, ring 44 continues to rotate so as to continuously wrap film web 58 around the members 140, conveyor 33 and load 36.

Figure 11:
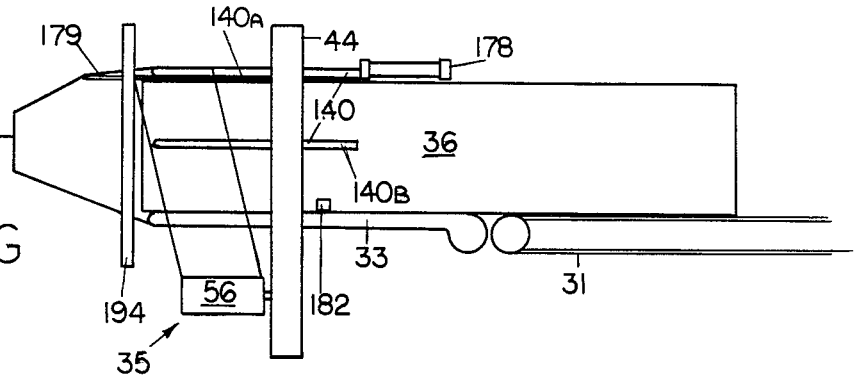
FIG. 11 is a schematic side view of the apparatus of FIG. 1 in a stage of operation subsequent to that shown in FIG. 10.

After the front edge of load 36 is detected by edge detector 183, motor 166 and ring 44 are halted as is shown in FIG. 10. In FIG. 11, cylinder 178 is activated through supply line 184 to extend rod 179 adjacent the top conveyor 140. The rod 179 is extended beyond the leading edge of load 36 so as to support the film web enclosure 198 extending beyond the leading edge of load 36. The sealer mechanism 194 is then activated. Just before the sealer mechanism contacts rod 179, the action of cylinder 178 is reversed and rod 179 is withdrawn.

Figure 12:
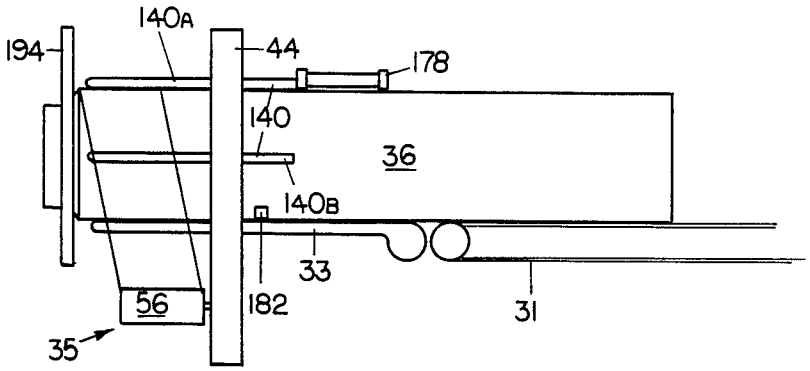
FIG. 12 is a schematic side view of the apparatus of FIG. 1 in a stage of operation subsequent to that shown in FIG. 11.

In the following sequence shown in FIG. 12, sealer mechanism 194 closes on and seals the film web enclosure 198. The sealer mechanism then withdraws from the load path. Ring 44 then resumes rotation, and motor 166 is reactivated to continue motion of load 36 through ring 44 and wrapping of the load with film web 58. Conveyor 32 is also activated to carry the load away from the wrapping area. As film web 58 slips off members 140 and conveyor 33, it collapses to its memory position against the load under tension.

Figure 13:
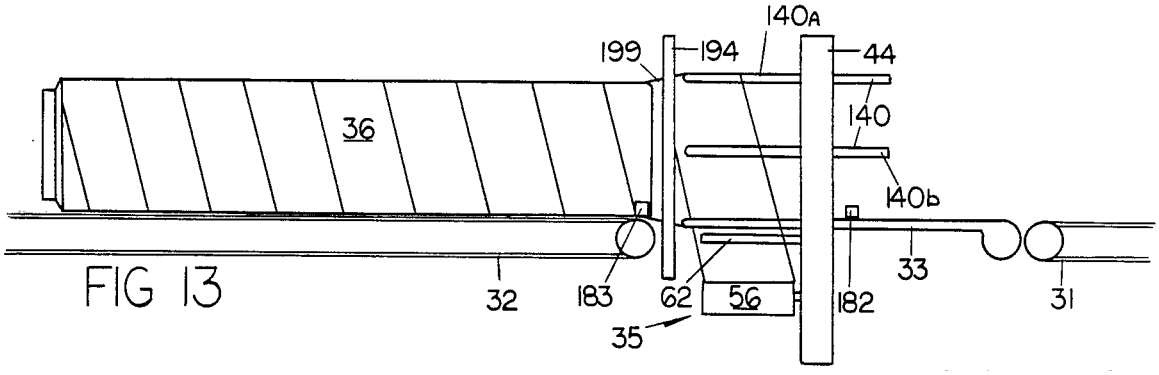
FIG. 13 is a schematic side view of the apparatus of FIG. 1 in a stage of operation subsequent to that shown in FIG. 12.
Figure 14:
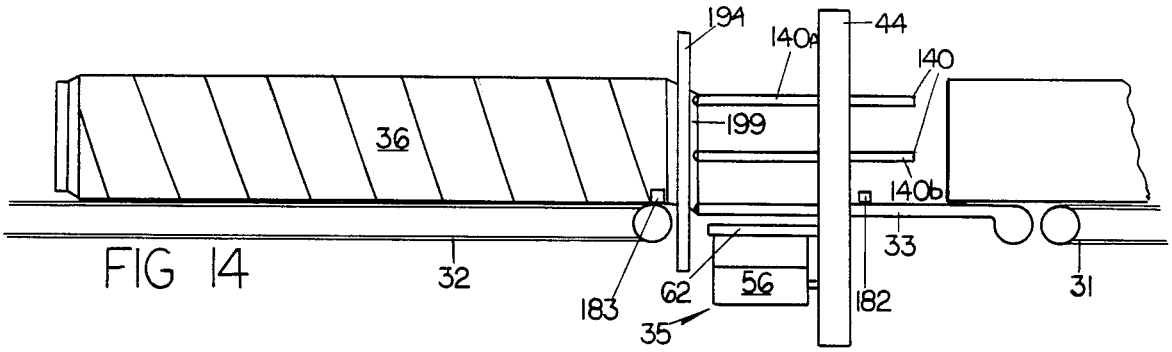
FIG. 14 is a schematic side view of the apparatus of FIG. 1 in a stage of operation subsequent to that shown in FIG. 13.

As is shown in FIG. 13, after the trailing edge of load 36 is detected by edge detector 183, conveyors 32 and 33 and members 140 are halted and the rotation of ring 44 is stopped with the film roll 56 directly adjacent clamps 62. Clamps 62 are then closed to grasp film web 58. In FIG. 14, the frames 146 are then moved towards conveyor 33 slightly by activation of motor 172 in order to release the film web enclosure 199 formed around members 140 and conveyor 33 following the load 36. Motor 172 is halted and rotating clamps 62 are rotated to grip and hold film web 58 directly adjacent film roll 56. The cutting mechanism 110 is then rotated into position and activated to cut the film web extending between clamps 62 and the load 36.

Figure 15:
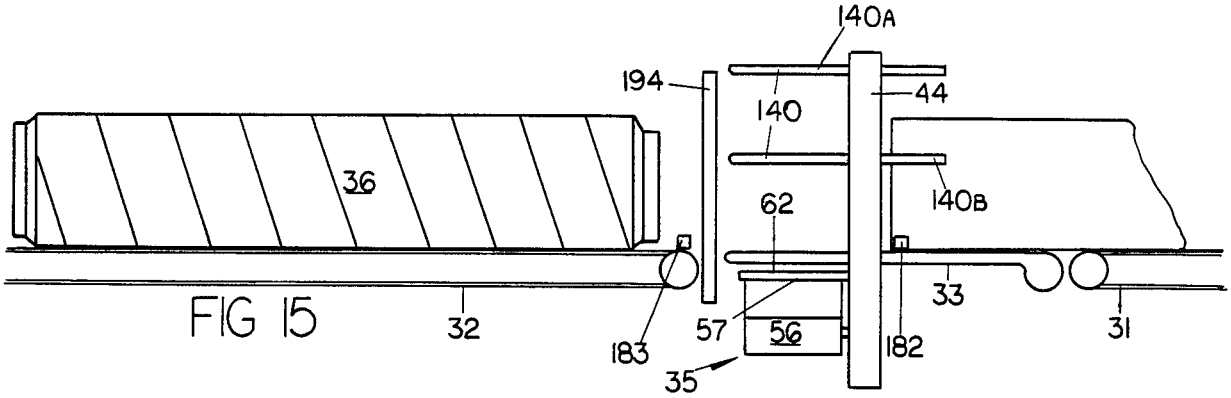
FIG. 15 is a schematic side view of the apparatus of FIG. 1 in a stage of operation subsequent to that shown in FIG. 14.

Finally, in FIG. 15, the sealer mechanism 194 is activated to seal the film web enclosure 199 against the trailing end of the load 36. The members 140 are retracted to the predetermined maximum distance. Take-off conveyor 32 is then activated to remove the completely wrapped load 36 from the system, and the system is again ready to wrap a subsequent load 36.

It should be noted that the steps of the wrapping process can be interchangeable without departing from the scope of the invention. Furthermore, these steps can be interchanged and are equivalent. In the foregoing description, the invention has been described with reference to a particular preferred embodiment, although it is to be understood that the specific details shown are merely illustrative, and the invention may be carried out in other ways without departing from the true spirit and scope of the following claims.

What is claimed is:

1. Apparatus for wrapping all surfaces of a cylindrical load comprising wrapping means, said wrapping means comprising a frame and a film dispensing means rotatably mounted on said frame, said film dispensing means when rotated defining a wrapping area, a wrapping conveyor assembly and tube forming support means located within said wrapping area, said wrapping conveyor assembly comprising at least one conveyor means adapted to transport said load and a film material dispensed by said film dispenser means, said film dispensing means being adapted to hold a roll of film material and wrap said film material around the load, said wrapping conveyor assembly and said tube forming support means; film stretching means mounted to said dispensing means engaging said film material to tension and stretch said film material being dispensed from said film dispensing means; take-off conveyor means spaced apart from said wrapping conveyor assembly; said wrapping conveyor means and said tube forming support means being adapted to transport said stretched film material wrapped around said conveyor and tube forming support means before, on and behind said load; said tube forming support means being adapted to support said stretched tensioned film web before and behind said load with a total surface area sufficient to cover planar leading and trailing ends of said load; and sealer means positioned downstream of said wrapping conveyor assembly adapted to seal said stretched film material before and behind said load so that said sealed stretched film material collapses against said planar leading and trailing ends of said load.

2. An apparatus as claimed in claim 1 wherein said tube forming support means comprises a plurality of tube forming supports, each of said tube forming supports being adapted to move toward and away from said load.

3. An apparatus as claimed in claim 2 further comprising an outer frame means surrounding said wrapping conveyor assembly, displacement means and drive means mounted on said outer frame and coupled to each said tube forming support, each said tube forming support being moveably coupled to said outer frame and adapted to be displaced by said displacement means and driven by said drive means.

4. An apparatus as claimed in claim 3 further comprising contact switch means mounted to one of said positionable conveyors and operatively coupled to said displacement means, said contact switch means being adapted to halt said displacement means when said contact switch means contacts said load.

5. An apparatus as claimed in claim 3 wherein said displacement means comprises a plurality of shafts fixed to said outer frame, a plurality of displacement frames, each said displacement frame being slideably mounted to at least two of said shafts, a plurality of displacement motion transfer means, each said displacement motion transfer means being attached to one said displacement frame; displacement motor means, at least one displacement drive shaft coupled to said displacement motor means and operatively coupled to said motion transfer means, said at least one displacement drive shaft being adapted to drive said displacement frames along said shafts, each said tube forming support being mounted to one said displacement frame.

6. Apparatus as claimed in claim 5 wherein each said displacement motion transfer means is adapted to convert rotation of said at least one displacement drive shaft to linear motion of said displacement frame.

7. An apparatus as claimed in claim 5 wherein each said tube forming support comprises skid means and endless belt means, said skid means being adapted to be held adjacent said load, said belt means being provided with an inner portion adjacent said skid means and an other portion spaced apart from said inner portion and said skid means.

8. An apparatus as claimed in claim 7 wherein said drive means comprises a conveyor drive motor, at least one conveyor drive shaft being driven by said motor and coupled to each said tube forming support, said at least one conveyor drive shaft being adapted to drive each said tube forming support.

9. An apparatus as claimed in claim 1 further comprising edge detector means operatively coupled to said wrapping conveyor assembly and said take-off conveyor means and is adapted to halt said take-off conveyor means and said wrapping conveyor assembly so that said leading or trailing end of said load is positioned to be sealed.

10. An apparatus as claimed in claim 9 wherein said sealer means is adapted to seal said film web against said leading or trailing end of said load.

11. Apparatus as claimed in claim 10 wherein said contact switch means is operatively connected to said film dispensing means and adapted to start said film dispensing means when said contact switch means contacts said load.

12. An apparatus as claimed in claim 9 wherein said edge detector means is operatively connected to said displacement means, said edge detector being further adapted to converge said tube forming supports to release said film web when said trailing end of said load is detected by said edge detector means.

13. An apparatus as claimed in claim 9 further comprising a film support means comprising actuation means and extensible rod means, said rod means being adapted to be extended beyond said leading end of said load by said actuation means to support said film web before said load.

14. An apparatus as claimed in claim 13 wherein said actuation means comprises fluid cylinder means.

15. An apparatus as claimed in claim 14 wherein said actuation means is further adapted to withdraw said extensible rod means when said sealer means approaches said extensible rod means.

16. An apparatus as claimed in claim 1 wherein said film stretching means comprises brake means mounted to said film dispensing means, said brake means being adapted to engage a roll of film web material mounted on said film dispensing means to place uniform tension on said roll and substantially stretch said film material dispensed from said roll onto said load.

17. An apparatus as claimed in claim 1 wherein said film stretching means is mounted on said film dispensing means and comprises at least an upstream roller and a downstream roller, said rollers being connected and driven by said film web pulled from said material roll so that the downstream roller transports the film web faster than the upstream roller to cause the film web to elongate between the rollers before reaching said load.

18. An apparatus as claimed in claim 17 wherein said film stretching means is powered.

19. Apparatus for wrapping all surfaces of cylindrical loads under tension comprising infeed means adapted to transport a load, wrapping means positioned adjacent said infeed means, said wrapping means comprising a frame and a film dispensing means rotatably mounted on said frame, said film dispensing means when rotated defining a wrapping area, a wrapping conveyor assembly and a plurality of positionable conveyors located within said wrapping area, said wrapping conveyor assembly comprising at least an upper conveyor means and a lower conveyor means within said wrapping area; said upper conveyor means being adapted to receive a load from said infeed means and to transport said load in a first direction away from said infeed means through said positionable conveyors, each said positionable conveyor being adapted to approach said load and to assume positions adjacent said load along the length of said load, said film dispensing means being adapted to hold a roll of film web and wrap said film web around said wrapping conveyor assembly and said positionable conveyors in front of, around and behind the load; take-off conveyor means located downstream from said wrapping conveyor assembly; said wrapping conveyor means and said positionable conveyors being adapted to move said film web wrapped around said load and said conveyors toward said take-off conveyor means; film stretching means mounted to said dispensing means engaging said film to tension and stretch said film web being dispensed from said film dispensing means, and sealer means positioned downstream from said film dispensing means adapted to engage said film web in front of and behind the load and to seal said film web under tension adjacent to planar leading and trailing ends of said load.

20. Apparatus for wrapping and sealing all surfaces of cylindrical random-diameter loads with tensioned stretched film material, comprising infeed means adapted to transport a load, wrapping means positioned adjacent said infeed means, said wrapping means comprising a frame and a film dispensing means rotatably mounted on said frame, said film dispensing means when rotated defining a wrapping area; a load conveyor and a plurality of positionable conveyors positioned within said wrapping area, said film dispensing means being adapted to hold a roll of film material and wrap said film material around the load, said load conveyor and said positionable conveyors to form a tensioned film tube extending beyond both planar ends of each said cylindrical load; said load conveyor comprising at least one upper conveyor means and at least one lower conveyor means within said wrapping area, said at least one upper conveyor means and said at least one lower conveyor means being driven at a substantially uniform speed; take-off conveyor means downstream and spaced apart from said load conveyor; said at least one upper conveyor means being adapted to transport said load in a downstream direction towards said take-off conveyor means; said at least one lower conveyor being adapted to transport said film web in said downstream direction; each said positionable conveyor being adapted to converge and contact each said load and to transport said film material wrapped around said load and around said positionable conveyor in said downstream direction at said substantially uniform speed to said take-off conveyor means; film stretching means mounted to said film dispensing means adapted to engage said film material to substantially stretch and tension said film material, and sealer means positioned downstream from said load conveyor, said sealer means being adapted to engage said film tube extending beyond said load and seal said film material under tension adjacent leading and trailing ends of said cylindrical load.

21. A process of making a unitary tensioned sealed package around all surfaces of a cylindrical load comprising the steps of:

(a) transporting a load on an infeed conveyor to a wrapping area, said wrapping area having a wrapping conveyor assembly comprising a conveyor surface and a plurality of tube forming support members extending therethrough;

(b) conveying said tube forming support members to positions in contact with the length of said load;

(c) wrapping said conveyor surface and said tube forming support members with a web of stretchable material which has been stretched to form a first film web tube leading a downstream planar end of said load;

(d) activating said infeed conveyor to transport said load an said first film web tube in a downstream direction through said wrapping area;

(e) wrapping said web of stretchable material which has been stretched around said load and said wrapping conveyor assembly a plurality of times;

(f) sealing said first web tube under tension against said downstream planar end of said load;

(g) wrapping said wrapping conveyor assembly with said web of stretchable material to form a second film web tube trailing an upstream planar end of said load;

(h) activating a take-off conveyor downstream from said wrapping conveyor assembly to transport said load and said second film web enclosure in a downstream direction;

(i) severing said web of stretchable material from said second film web enclosure; and (j) sealing said second film web enclosure under tension against said upstream planar end of said load.

22. A process as claimed in claim 21 further comprising the step after step (a) of contracting said tube forming support members toward said load, and the step after step (j) of retracting said tube forming support members to a predetermined maximum position.

23. A process as claimed in claim 21 wherein said film web enclosures are collapsed and sealed against said load.

24. A process as claimed in claim 23 further comprising the step after step (f) of supporting said first film web enclosure with extensible support means.

25. A process as claimed in claim 21 wherein each said tube forming support member comprises skid plate means adapted to contact said load, and conveyor means adapted to transport said web in a downstream direction at a speed corresponding to said speed of said infeed conveyor.

26. A process of wrapping and enclosing a random diameter cylindrical load with stretched film web comprising the steps of:

(a) transporting a load to a conveyor assembly positioned within a wrapping area, said conveyor assembly comprising a load conveyor and at least one tube forming support member, said conveyor assembly being adapted to transport said load and a stretched film web wrapped around said load and said conveyor assembly in a downstream direction;

(b) wrapping said conveyor assembly with a stretched film web from a dispensing apparatus to form a first film web tube portion leading a downstream end of said load;

(c) transporting said first film web tube portion and load in a downstream direction through said wrapping area;

(d) wrapping said stretched film web around said load a plurality of times;

(e) stretching and sealing first film web tube portion against said downstream end of said load;

(f) wrapping said conveyor assembly with said film web to form a second film web tube portion trailing an upstream end of said load; and (g) stretching and sealing said second film web tube portion against said upstream end of said load to form an enclosed load.

27. A process as claimed in claim 26 including the step of severing said film web from said dispensing apparatus before the second film enclosure portion is sealed.

28. A process as claimed in claim 26 further comprising the step after step (a) of contracting said tube forming support members toward said load, and the step after step (g) of retracting said tube forming support members to a predetermined position.

29. A process as claimed in claim 26 further comprising the step after step (d) of supporting said first film web enclosure with extensible support means.

* * * * *